US008014550B2

(12) United States Patent
Bramsløw

(10) Patent No.: US 8,014,550 B2
(45) Date of Patent: Sep. 6, 2011

(54) SYSTEM FOR CONTROLLING A TRANSFER FUNCTION OF A HEARING AID

(75) Inventor: Lars Bramsløw, Smørum (DK)

(73) Assignee: Oticon A/S, Smordum (DK)

( * ) Notice: Subject to any disclaimer, the term of this patent is extended or adjusted under 35 U.S.C. 154(b) by 1295 days.

(21) Appl. No.: 11/640,950

(22) Filed: Dec. 19, 2006

(65) Prior Publication Data

US 2007/0165891 A1 Jul. 19, 2007

(30) Foreign Application Priority Data

Dec. 21, 2005 (EP) ..... 05112659

(51) Int. Cl.
*H04R 25/00* (2006.01)

(52) U.S. Cl. ..... 381/321; 381/312

(58) Field of Classification Search ..... 381/317, 381/321

See application file for complete search history.

(56) References Cited

U.S. PATENT DOCUMENTS

| | | | | |
|---|---|---|---|---|
| 5,687,241 | A * | 11/1997 | Ludvigsen | 381/312 |
| 5,903,655 | A * | 5/1999 | Salmi et al. | 381/321 |
| 6,735,317 | B2 * | 5/2004 | Paludan-Mueller | 381/317 |
| 6,748,092 | B1 | 6/2004 | Baekgaard | |

FOREIGN PATENT DOCUMENTS

| | | | |
|---|---|---|---|
| CA | 2090531 | A1 | 8/1994 |
| WO | WO-98/18294 | A1 | 4/1998 |

* cited by examiner

*Primary Examiner* — Curtis Kuntz
*Assistant Examiner* — Sunita Joshi
(74) *Attorney, Agent, or Firm* — Birch, Stewart, Kolasch & Birch, LLP

(57) ABSTRACT

This invention relates to a system (100) for controlling gain function of a hearing aid. The system (100) comprises a microphone (102) converting a sound pressure to an input signal, a speaker (112) converting an output signal to a processed sound pressure, and a signal processing means (106) interconnecting the microphone (102) and the speaker (112) and processing the input signal to the output signal according to a control signal. The system (100) further comprises a signal analysis means (108) connecting to the microphone (102) and to the signal processing means (106) and comprising a controller means (124) generating the control signal based on detector means (128, 130, 120) responses to the input signal.

9 Claims, 1 Drawing Sheet

SYSTEM FOR CONTROLLING A TRANSFER FUNCTION OF A HEARING AID

FIELD OF INVENTION

This invention relates a system for controlling a transfer function of a hearing aid, such as in behind-the-ear (BTE), in-the-ear (ITE), in-the-canal (ITC), and completely-in-canal (CIC) hearing aids.

BACKGROUND OF INVENTION

A state of art digital hearing aid performs non-linear processing of a converted acoustic signal by adjusting gain as a function of input level and frequency composition of the acoustic signal, within a maximum achievable power output of the hearing aid.

The relationship between the gain and frequency for the hearing aid, generally referred to as the gain transfer function, is determined in accordance with a user's hearing impairment, which is described at least by a minimum detectable sound pressure level and uncomfortable sound pressure level as functions of frequency, and is obviously determined by the maximum power output achievable from the hearing aid. Maximum power output is in this context to be construed as the maximum power at which the hearing aid does not deteriorate or distort the audio signal.

Hence the hearing aid must amplify the acoustic signal so as to provide a sound pressure level of desired/useful sounds to the user above the minimum detectable sound pressure level while avoiding sound pressure levels at the uncomfortable sound pressure level or at the maximum power output. Therefore the gain of the hearing aid is adjusted as a function of the input levels, thus providing dynamic amplification range compression.

In addition, the hearing aid gain is adjusted for suppressing internal input noise from, for example, the microphone, and for suppressing acoustic feedback caused by the proximity of the speaker and microphone.

The terms "attack" and "release" times, which are used hereinafter, are to be construed as the time interval from a sudden increase or decrease of the input level by a predetermined amount in dB until stabilization of the output level from the hearing aid is within +/−2 dB. The attack time is the time required for the hearing aid to initiate an appropriate gaining or dampening process in response to an input change, whereas the release time is the time required for the hearing aid to return to previous operation.

U.S. Pat. No. 4,630,302, which is incorporated by reference in the below specification, discloses a hearing aid apparatus comprising means for differentiating speech signals from typical low level background noise signals present in or derived from microphone means. The apparatus utilizes an automatic gain control amplifier having short attack and long release times, in a manner such that speech signal segments are compressed and have a substantially long time average level. The term "compressed" is in this context to be construed as reduction of gain as a function of increasing input level.

The hearing aid apparatus according to U.S. Pat. No. 4,630,302 further utilizes a noise suppressor having a long attack time (longer than time constants of typical speech segments) and short release time. The noise suppressor is responsive to the output of the automatic gain control amplifier, and has an initiation threshold below the effective specified level of automatic gain control action for the automatic gain control amplifier, say 12 dB. Thus when the output of the automatic gain control amplifier is above the squelch threshold for periods longer than the attack time of the noise suppressor the squelch action is activated, and when the output is below the squelch threshold for a few milliseconds the squelch action is de-activated. Hence speech segments, which typically vary over at least a 12 dB range within periods shorter than the attack time of the noise suppressor, pass through the noise suppressor without being squelched, whereas background noise signal segments which typically present a more steady time average level longer than the attack time of the noise suppressor will be squelched.

However, the long release time of the automatic gain control amplifier disclosed in U.S. Pat. No. 4,630,302 presents a disadvantage in operating a hearing aid in varying sound environments. For example, when a user is exposed to a high sound level, such as caused by the user shouting at a person situated remotely or a door is slammed nearby, the user will be unable to hear low sound levels during a longer period thereafter.

U.S. Pat. No. 6,628,795, which is incorporated by reference in the below specification, discloses a method for automatic, gain control in a hearing aid effected by detecting an input level and/or an output level and adapting the output level in response to the input level by controlling the gain of the hearing aid towards a desired value for the output level. Further, the gain control adjusts attack and release times in response to the detected input level so that a fast gain adjustment is performed at a high input level change and a slow gain adjustment is performed at a low input level change. Thus the gain control provides short attack and release times for input level changes in the high input level area and long attack and release times for input level changes in the low input level area.

However, the method according to U.S. Pat. No. 6,628,795 providing long attack and release times for low level signals introduces a disadvantage in reducing noise, since the user of a hearing aid incorporating this method might loose some speech signals since the release time is long during low input level situations, and therefore in situations where the user moves from a low or no sound situation to a higher level sound situation some information is lost.

SUMMARY OF THE INVENTION

An object of the present invention is to provide a hearing aid system to solve above identified problems associated with controlling gain transfer function of a hearing aid.

It is a further object of the present invention to provide a hearing aid system, which according to a wide variety of sound environments provides the optimum gain function.

A particular advantage of the present invention is the provision of specific attack and release times associated with specific operations of the hearing aid system.

A particular feature of the present invention is the provision of a parallel signal path for determining appropriate attack and release times, thus optimizing the gain function for any sound situation.

The above objects, advantage and feature together with numerous other objects, advantages and features, which will become evident from below detailed description, are obtained according to a first aspect of the present invention by a system for controlling gain function of a hearing aid, and comprising a microphone adapted to convert a sound pressure to an input signal, a speaker adapted to convert an output signal to a processed sound pressure, a signal processing means interconnecting said microphone and said speaker and adapted to process said input signal to said output signal according to a control signal, and a signal analysis means connecting to said microphone and to said signal processing means, and wherein said signal analysis means comprises a first signal path having first detector means adapted for maximum level and squelch level detection and a second signal path having second detector means adapted for compression level detection and a controller means adapted to generate said control signal based on said first and second detector means responses to said input signal.

The term "maximum level" or "maximum power output" (MPO) is in this context to be construed as the maximum achievable output signal without distortion or the maximum allowable output level at which sounds stay below the uncomfortable level (UCL) of the hearing aid user, whichever is the lower of the two. That is, a maximum level may be detectable from an input signal together with a particular gain of a compressor of the hearing aid system.

The term "squelch level" is in this context to be construed as an input signal below which amplification of the signal processing means should be reduced.

The system according to the first aspect of the present invention provides a precise solution for ensuring appropriate attack and release times for any input signals thereby overcoming the problems identified in the prior art.

The first signal path according to the first aspect of the present invention may comprise a first filterbank adapted to separate the input signal into a first plurality of frequency band signals. The first signal path may further comprise a maximum level detector receiving a frequency band signal of the first plurality and being adapted to notify said controller, when the frequency band signal of the first plurality is above a maximum threshold, with a short attack and short release times to enable the controller means to generate the control signal reducing gain of the signal processing means. Thus the first signal path may comprise a maximum level detector for each of the first plurality of frequency band signals. Hence the system quickly reacts to avoid any gains of the signal processing means, which will cause the system to present output signals in any frequency band above maximum rating of the system, and which thus will cause distortion or an uncomfortable sound level. In addition, the short release time of the maximum level detector ensures that the system quickly returns to normal operation when the input signals return below the maximum threshold.

The first signal path according to the first aspect of the present invention may further comprise a squelch level detector receiving a frequency band signal of the first plurality and being adapted to notify said controller means, when the frequency band signal of the first plurality is below a squelching threshold, with long attack and short release times to enable the controller means to generate the control signal reducing gain of the signal processing means. Thus the first signal path may comprise a squelch level detector for each of the first plurality of frequency band signals. Hence the system, following a period of input signals below the squelching threshold, reacts by reducing gain of the signal processing means so as avoid unnecessary amplification of internal noise such as generated by the microphone. However, whenever the input signal is above the squelching threshold the system reacts quickly by returning to normal gain operation of the signal processing means.

The term "notify" is in this context to be construed as communicating information, for example by generating an information signal and forwarding this either directly or indirectly to a recipient. Further, the terms "short" and "long" as used in connection with the attack and release times are to be construed as relative to the situation in which they are used. For example, for maximum level detection typical attack times may be in the range between 0 and 5 milliseconds and typical release times are in the range between 10 and 50 milliseconds, and for squelch level detection typical attack times may be in the range between 50 milliseconds and several hundreds of milliseconds and release times may be as long as several seconds.

The second signal path according to the first aspect of the present invention may comprise a second filterbank adapted to separate the input signal into a second plurality of frequency band signals. The second signal path may further comprise a compression level detector adapted to determine signal level of each of said frequency band signals, and a table storing a user prescription adapted to generate a gain information signal for the controller means based on said signal level of each of said frequency band signals and said user prescription. The controller means thus generates a control signal to the signal processing means in accordance with a hearing impaired user's prescription. That is, amplifying input signals below the user's minimum detectable sound pressure level while avoiding sound pressure levels at the uncomfortable sound pressure level.

The first filterbank according to the first aspect of the present invention may comprise a fast-channel wideband filterbank. The second filterbank may comprise a multi-channel narrowband filterbank, such as 16 channels. By introducing a separate filterbank for handling input signals in the compression area and a filterbank for handling input signals in the extreme sound pressure level enables the selection of specific channel bandwidths for the best compromise between fast response time (MPO) and high frequency resolution (compression). Further by having a detector associated to each frequency band of the first and second filterbank separate attack and release times may be selected for optimization relative to frequency and function e.g. maximum level detectors having substantial short attack and release times, squelch level detectors having substantial long attack and short release times, and finally compression level detector having any desired attack and release time for any frequency band.

The controller means according to the first aspect of the present invention may ensure rule based modifications performed on the input signal by the signal processing means so as to continuously present the optimum sounds to the user of the hearing aid.

The signal processing means according to the present invention may comprise a multi-channel active filter adapted to separate the input signal into a plurality of frequency band signals and to independently process each frequency band signal according to a user prescription. Alternatively, the signal processing means may comprise a digital signal processor.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawing, wherein.

DETAILED DESCRIPTION OF PREFERRED EMBODIMENTS

Figure 1:
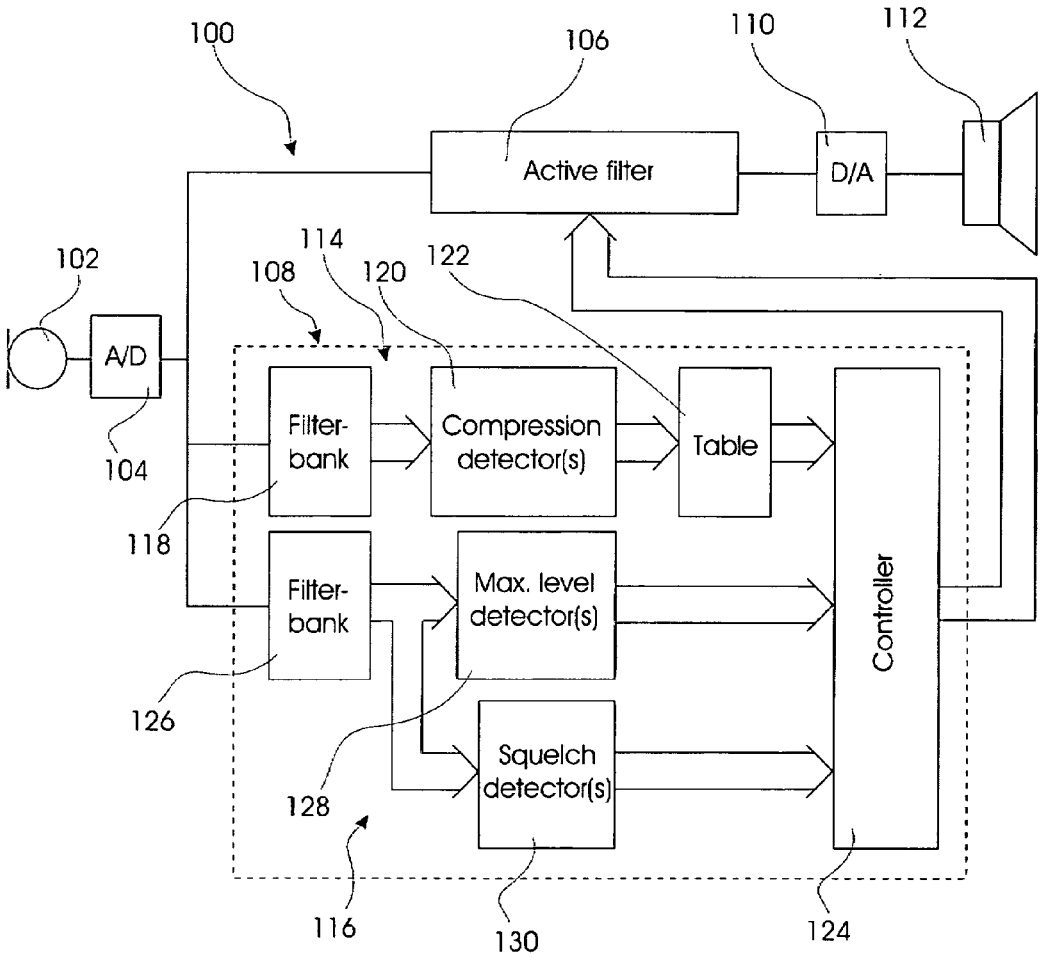
FIG. 1, shows a block diagram of a first embodiment of the present invention.

In the following description of the various embodiments, reference is made to the accompanying figure, which shows by way of illustration how the invention may be practiced. It is to be understood that other embodiments may be utilized and structural and functional modifications may be made without departing from the scope of the present invention.

FIG. 1, shows a hearing aid system designated in entirety by reference numeral 100 and comprising a microphone 102 for converting incoming sound pressure to an electric signal.

The electric signal is communicated to an analogue to digital (A/D) converter 104 converting the electric signal into a digital signal. The digital signal is then forwarded to a signal processor 106 and a signal analysis unit 108.

The signal analysis unit 108 performs signal analysis of the digital signal and generates a control signal to the signal processor 106, which enables the signal processor 106 to perform an appropriate processing of the digital signal and provide a digital output to a digital to analogue (D/A) converter 110. The digital to analogue converter 110 converts the digital output from the signal processor 106 to an analogue output signal to be forwarded to a speaker 112 presenting the processed sound to a user of the hearing aid.

The signal analysis unit 108 comprises a first signal path 116 parallel to a second signal path 114. The first signal path 116 comprises a first filterbank 126, such as a fast-channel wideband filterbank, for separating the digital signal into a first plurality of frequency band signals. The term "frequency band" is in this context to be construed as a frequency channel. Each of the first plurality of frequency band signals is provided in parallel to a maximum level detector 128 and a squelch detector 130.

Each of the first plurality of frequency band signals is communicated to the maximum level detector 128, and when any of the first plurality of frequency band signals exceed the maximum level defined by a maximum input threshold, the maximum level detector notifies the controller 124, which includes this information as basis for generating the control signal to the signal processor 106. The maximum level detector(s) 128 have short attack and release times so that the controller 124 may perform swift reactions to reduce gain when the maximum input level has been exceeded.

Similarly, each of the first plurality of frequency band signals is communicated to the squelch detector 130, and when any of the first plurality of frequency band signals is below the squelch level defined by a squelch input threshold, the squelch detector 130 notifies the controller 124, which includes this information as basis for generating the control signal to the signal processor 106. The squelch detector(s) 130 have long attack and short release time so that the controller 124 activates the squelching operation when only noise is present.

The second signal path 116 controls the ordinary operation of the hearing aid system 100. That is, operations within the wide dynamic range compression range. The second signal path 116 comprises a second filterbank 118 for separating the digital signal into a second plurality of frequency band signals.

The second filterbank 118 according to the first embodiment of the present invention comprises a multi-channel narrow band filterbank. In the figure the first and second plurality of channels or bands are illustrated in the form of thick arrows. Each of the channels is connected to a compression level detector 120 continuously indexing the second plurality of frequency band signals so as to enable the controller 124 to generate a control signal identifying appropriate gain for each of the channels in accordance with a user's hearing aid prescription. The indexing, in fact, controls a compression gain table 122 storing the user's hearing aid prescription to provide the appropriate information to the controller 124. The compression gain table 122 communicates the gain information, namely the gain to the controller 124 converting the information into a control signal controlling the signal processor 106.

The compression level detectors 120 are programmed or configured with attack and release times for each frequency channel in accordance with a user's hearing aid prescription.

The control signal of the controller 124 provides control information to the signal processor 106 regarding gain of each of the first and second plurality of frequency bands examined by the signal analysis unit 108.

By introducing a separate signal path for maximum output power and squelch detection and for wide dynamic range compression great advantages are achieve over prior art. In many prior art digital compression systems, the MPO-limitation, the dynamic range compression, and the soft squelch is governed by the same compression table and the same level detectors. This means that the effective numbers of channels, as well as the attack and release times are the same for all three functions, and thus some compromises have to be made, leading to less-than-optimal dynamic properties of the hearing aid. For instance, the hearing aid will not recover quickly from MPO-limitations, if the compression requires long release times. In addition, the processing of very soft speech signals will be affected by the (undesired) action of the soft squelch.

In the system 100 according to the first embodiment, the hearing aid uses a separate path for signal analysis and for signal processing. The analysis path uses separate filters for compression and for maximum power limitation and squelching, and separate time constants for all three non-linear functions.

Finally, the system 100 may comprise a plurality of microphones connected so as to enable the system 100 to perform directionality operations. In addition, the system 100 may comprise a feedback elimination unit for reducing potential acoustic feedback caused by the proximity of the microphone and speaker.

The invention claimed is:

1. A system for controlling gain function of a hearing aid, the system comprising:

a microphone adapted to convert a sound pressure to an input signal, a speaker adapted to convert an output signal to a processed sound pressure, a signal processor interconnecting said microphone and said speaker and adapted to process said input signal to said output signal according to a control signal, and a signal analyzer connecting to said microphone and to said signal processor, and wherein said signal analyzer -includes a first signal path having first detector adapted for maximum level and squelch level detection, where said first signal path includes a first filterbank adapted to separate said input signal into a first plurality of frequency band signals and where said first detector is configured to perform maximum level and squelch level detection for each of said first plurality of frequency band signals, and a second signal path having second detector adapted for compression level detection, where said second signal path include a second filterbank adapted to separate said input signal into a second plurality of frequency band signals and where said second detector is configured to perform signal level detection for each of said second plurality of frequency band signals, and a controller adapted to generate said control signal to control gain levels of said signal processor based on said first and second detector responses to said input signal such that a detection in excess of a maximum level threshold and /or below a squelching threshold in a frequency band signal in the first signal path causes a corresponding gain reduction in said signal processor and such that a detection of a signal level below a user's minimum detectable sound pressure in a frequency band signal in the second signal path causes a corresponding gain increase in said signal processor.

2. A system according to claim 1, wherein said first signal path comprises a maximum level detector receiving a frequency band signal of said first plurality and adapted to notify said controller, when said frequency band signal of said first plurality is above a maximum threshold, with a short attack and short release time to enable said controller to generate said control signal reducing gain of said signal processor.

3. A system according to claim 1 or 2, wherein said first signal path comprises a squelch level detector receiving a frequency band signal of said first plurality and adapted to notify said controller, when said frequency band signal of said first plurality is below a squelching threshold, with long attack and short release time to enable said controller to generate said control signal reducing gain of said signal processor.

4. A system according to claim 1, wherein said second signal path comprises a compression level detector adapted to determine signal level of each of said frequency band signals, and a table storing a user prescription adapted to generate a gain information signal for said controller based on said signal level of each of said frequency band signals and said user prescription.

5. A system according to claim 4, wherein said compression level detector comprises programmable attack and release times for each frequency band signal of said second plurality.

6. A system according to claim 1, wherein said first filterbank comprises a fast-channel wideband filterbank.

7. A system according to any of claims 1, 4, 5, or 6, wherein said second filterbank comprises a multi-channel narrowband filterbank, such as 16 channels.

8. A system according to claim 1, wherein said signal processor comprises a multi-channel active filter adapted to separate said input signal into a plurality of frequency band signal and to independently process each frequency band signal according to a user prescription.

9. A system according to claim 1, wherein said signal processor comprises a digital signal processor.

* * * * *